US007198048B2

(12) United States Patent
Johnson

(10) Patent No.: US 7,198,048 B2
(45) Date of Patent: Apr. 3, 2007

(54) SYSTEM AND METHOD FOR MANAGEMENT OF HAIR AND PERSONAL HYGIENE

(75) Inventor: John E. Johnson, 12620 Britton Dr., Cleveland, OH (US) 44120

(73) Assignee: John E. Johnson, Canton, OH (US)

( * ) Notice: Subject to any disclaimer, the term of this patent is extended or adjusted under 35 U.S.C. 154(b) by 0 days.

(21) Appl. No.: 10/966,015

(22) Filed: Oct. 15, 2004

(65) Prior Publication Data

US 2006/0081268 A1 Apr. 20, 2006

(51) Int. Cl.
*A45D 24/16* (2006.01)
*A47L 13/00* (2006.01)

(52) U.S. Cl. ..... 132/125; 15/106; 15/176.1; 15/202; 132/139; 132/122; 132/148; 132/150

(58) Field of Classification Search ..... 132/120, 132/122, 123, 150, 125, 148, 139, 226, 237; 15/105, 114, 118, 176.1, 176.4, 176.5, 176.6, 15/202

See application file for complete search history.

(56) References Cited

U.S. PATENT DOCUMENTS

| | | | | |
|---|---|---|---|---|
| 202,161 | A | 4/1878 | Finley | |
| 288,534 | A | 11/1883 | Wilkerson | |
| 525,337 | A | 9/1894 | Cooper | |
| 1,206,679 | A | 11/1916 | Cummings | |
| 2,148,927 | A | 2/1939 | Conway | |
| 2,160,618 | A | 5/1939 | Kreutzig | |
| 2,181,448 | A | 11/1939 | Behr | |
| 2,261,747 | A | 11/1941 | Vegh | |
| 2,446,086 | A | 7/1948 | Hermans | |
| 2,450,344 | A | 9/1948 | Jung | |
| 2,470,157 | A * | 5/1949 | Gambino | 132/125 |
| 2,473,227 | A * | 6/1949 | Solomon | 132/120 |
| 2,648,082 | A * | 8/1953 | Teetsel | 15/106 |
| 2,799,283 | A * | 7/1957 | Kapusnyk | 132/120 |
| 3,083,715 | A | 4/1963 | Trabish | |
| 3,084,700 | A | 4/1963 | Fischer et al. | |
| 4,368,376 | A * | 1/1983 | Andis | 219/222 |
| 5,007,442 | A | 4/1991 | Hirzel | |
| 5,337,765 | A * | 8/1994 | Wong | 132/120 |

(Continued)

*Primary Examiner*—Todd E. Manahan
*Assistant Examiner*—Rachel A. Running
(74) *Attorney, Agent, or Firm*—Fay Sharpe LLP

(57) ABSTRACT

A system and method for the management of hair and personal hygiene is provided. The system comprises a hair care instrument including a mounting base having opposing sides each defining a mounting portion in its cross-section. The base includes a proximal end. A first implement is removably connected to at least one of said opposing sides of said base. A handle is provided having an interface edge, the interface edge is adjacent the proximal end of the base, wherein the handle is removably connected to the proximal end of the mounting base.

A method of managing personal hygiene for a plurality of users comprising the steps of: providing a personal hygiene tool including a handle removably connected to a first base; connecting the handle to the first base; providing a family of hygiene management implements; connecting at least one of the family of hygiene management implements to the first base; using the at least one of the family of hygiene management implements on a selected first user; removing the at least one of the family of hygiene management implements from the first base; and, connecting at least another of the family of hygiene management implements to the first base.

25 Claims, 6 Drawing Sheets

U.S. PATENT DOCUMENTS 5,365,880 A * 11/1994 South ..... 119/602
5,427,120 A * 6/1995 Wong ..... 132/120
5,449,006 A 9/1995 Hogan et al.
5,960,745 A 10/1999 Boyland
5,992,423 A 11/1999 Trevolini
6,029,307 A 2/2000 Baudoin
6,382,216 B1 5/2002 Clark
6,789,549 B2 * 9/2004 Johnson ..... 132/120
2004/0255967 A1 * 12/2004 White et al. ..... 132/120

* cited by examiner

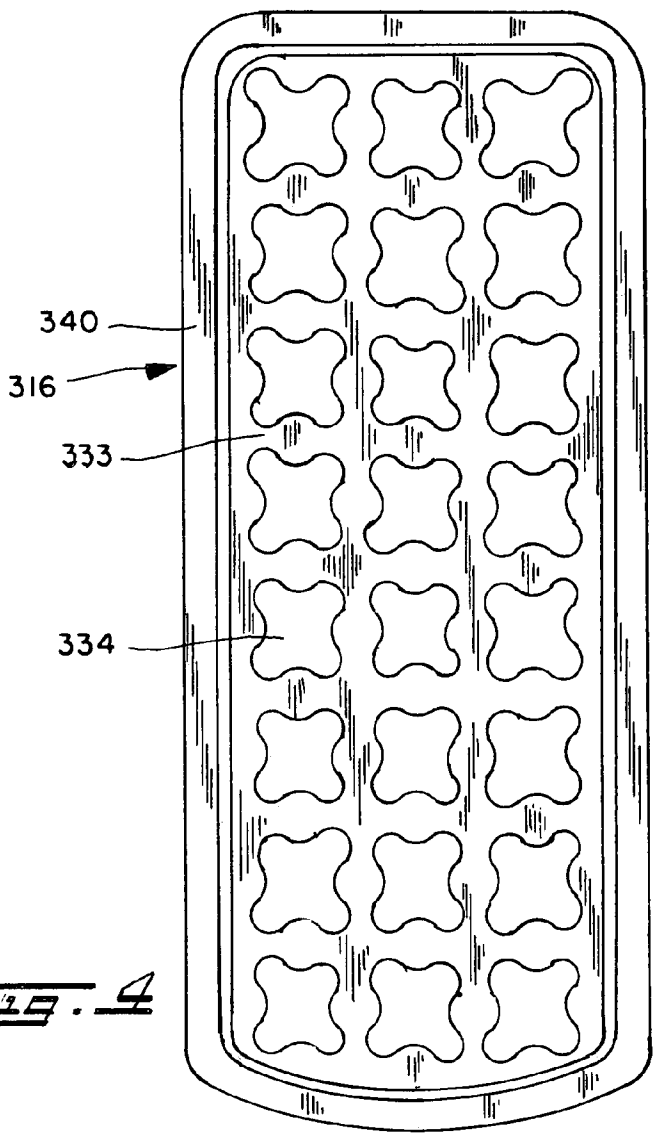
Fig. 4
Fig. 3
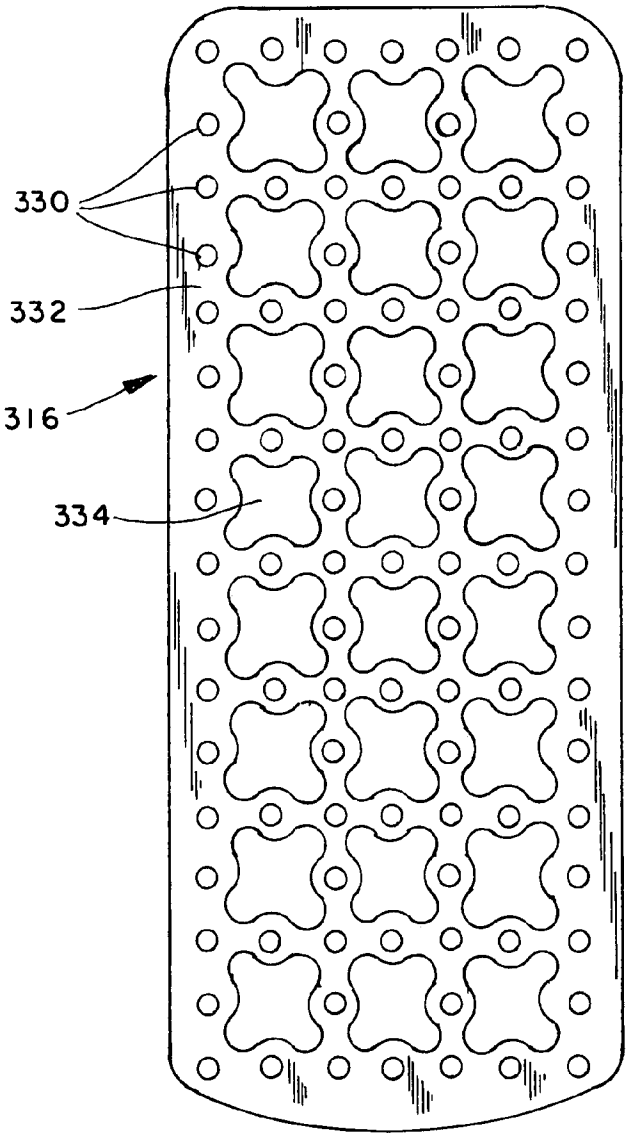

SYSTEM AND METHOD FOR MANAGEMENT OF HAIR AND PERSONAL HYGIENE

FIELD OF THE INVENTION

The present invention relates to hair care and personal hygiene. More particularly, the present invention relates to a new system and method for the management of hair and personal hygiene.

DESCRIPTION OF RELATED ART

Typically, devices for the management of hair and personal hygiene, such as combs, brushes and the like, are separate integrated units. Thus, when a hair care professional such as a barber or stylist needs to utilize a combination of items such as a comb and a brush, that person must use one item and set it down before picking up the next item. This may create clutter and may be difficult for a busy professional who needs to change tools often, sometimes causing the barber or stylist to drop the devices onto an unsanitized floor compromising hygiene. These devices also pose problems for the average person who utilizes them, such as an individual who may be visually challenged. Having several separate items may create confusion with the increased clutter they cause.

In addition, typical hair management and personal hygiene devices, i.e. combs, have small handles. Thus, when a person with arthritis or a similar condition attempts to hold and use the device, it is often difficult and painful. Such small handles also present problems for professionals utilizing the tools for extended periods of time. These professionals use techniques known in the art that may be problematic with devices of the prior art. Such techniques include the clipper-over-comb and the comb-brush techniques. For example, in the clipper-over-comb technique, hair to be cut is drawn away from a customer's head by a comb which is grasped in between the forefinger and thumb of the barber or stylist. Once the portion of hair held out by the comb is cut, the comb is rotated under the next portion of hair to be cut and then rotated out so as to hold that hair away from the customer's head. This process continues for each customer until all of that customer's hair has been cut. Performing this repeated rotation of the small-handled hair management device throughout the day may cause severe discomfort.

Moreover, constant rotation of the apparatus using the forefinger and thumb becomes an awkward maneuver due to the small, flat handle types of devices of the prior art, again causing the barber or stylist to drop the tool and forcing her or him to obtain a new, sanitary one. If the barber or stylist attempts to overcome this problem by rotating the device through raising and dropping his or her wrist, such repeated wrist motion may cause pain and even problems such as carpal tunnel syndrome. Thus, problems are created by devices of the prior art through separate hair management instruments and small handle configurations that do not allow easy and firm gripping and rotation.

Personal hygiene and hair management devices in a commercial, or multi-user, setting necessitate sanitizing the management instruments between uses. Cleaning and sanitizing the instruments is cumbersome due to the number of instruments that can be used on any one individual and due to the bulk of separate devices. Current separate management devices do not provide for single use disposable instruments or implements, nor do they provide an economical and simple means for sanitizing multi-use instruments between uses. Also, a significant monetary investment is necessary to acquire all the multi-use devices desired, particularly in a commercial setting.

There have been attempts to combine hair management devices in the past. For example, U.S. Pat. No. 288,534 issued to Wilkerson discloses a comb having a solid end which forms the back of a brush. U.S. Pat. No. 2,261,747 issued to Vegh discloses a brush with a handle forming a comb. However, these devices lack the flexibility to adapt to different implements and do not allow the user to easily grip or rotate the apparatus.

Accordingly, it is desirable to develop a new apparatus for the management of hair which would overcome the foregoing difficulties by providing for the use of multiple instruments while allowing for easier grip and rotation by a user.

SUMMARY OF THE INVENTION

According to the present invention, a new system and method for the management of hair and personal hygiene is provided.

In accordance with an exemplary embodiment of the present invention, a system and method for the management of hair and personal hygiene is provided. The system includes a hair care instrument having a mounting base with opposing sides each defining a mounting portion in its cross-section. The base includes a proximal end. A first implement is removably connected to at least one of the opposing sides of the base. A handle is provided having an interface edge, the interface edge is adjacent the proximal end of the base, wherein the handle is removably connected to the proximal end of the mounting base.

In accordance with another exemplary embodiment of the present invention, a system for the management of hair is provided. The system comprises a first hair management implement and a second hair management implement. A central base is provided having a first side and a second side. The system includes a first means for removably securing the first hair management implement to the first side of the central base and a second means for removably securing the second hair management implement to the second side of the central base. The first and second hair management implements each include a mounting surface and opposing mounting edges, the mounting surface includes a plurality of apertures therethrough, wherein the mounting edges removably engage the central base.

In accordance with yet another exemplary embodiment of the present invention, a method of managing personal hygiene is described for a plurality of users comprising the steps of: providing a personal hygiene tool including a handle removably connected to a first base; connecting the handle to the first base; providing a family of hygiene management implements; connecting at least one of the family of hygiene management implements to the first base; using the at least one of the family of hygiene management implements on a selected first user; removing the at least one of the family of hygiene management implements from the first base; and, connecting at least another of the family of hygiene management implements to the first base.

The benefits and advantages of the invention will become apparent to those skilled in the art upon reading and understanding the following detailed description.

BRIEF DESCRIPTION OF THE DRAWINGS

The invention may take form in certain components and structures, exemplary embodiments of which will be illustrated in the accompanying drawings wherein:

FIG. 3 is a top view of an alternative hair management implement for use with the device shown in FIG. 1;

FIG. 4 is a bottom view of the alternative hair management implement shown in FIG. 3;

DETAILED DESCRIPTION OF EXEMPLARY EMBODIMENTS

Figure 1:
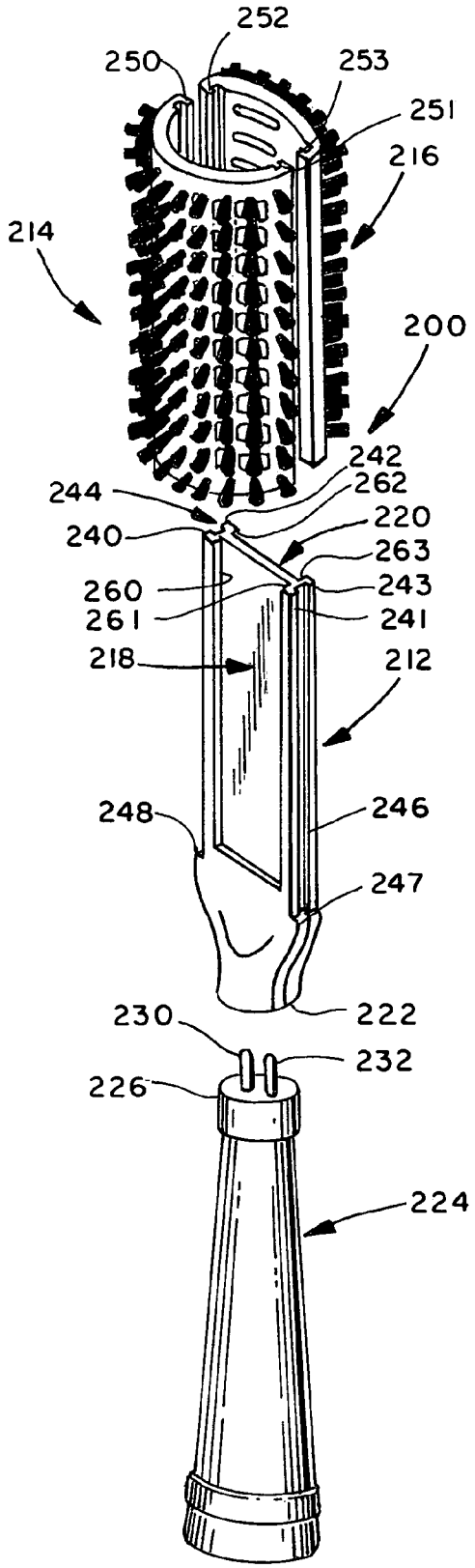
FIG. 1 is an exploded perspective view of an apparatus for the management of hair in accordance with an exemplary embodiment of the present invention.
Figure 2:
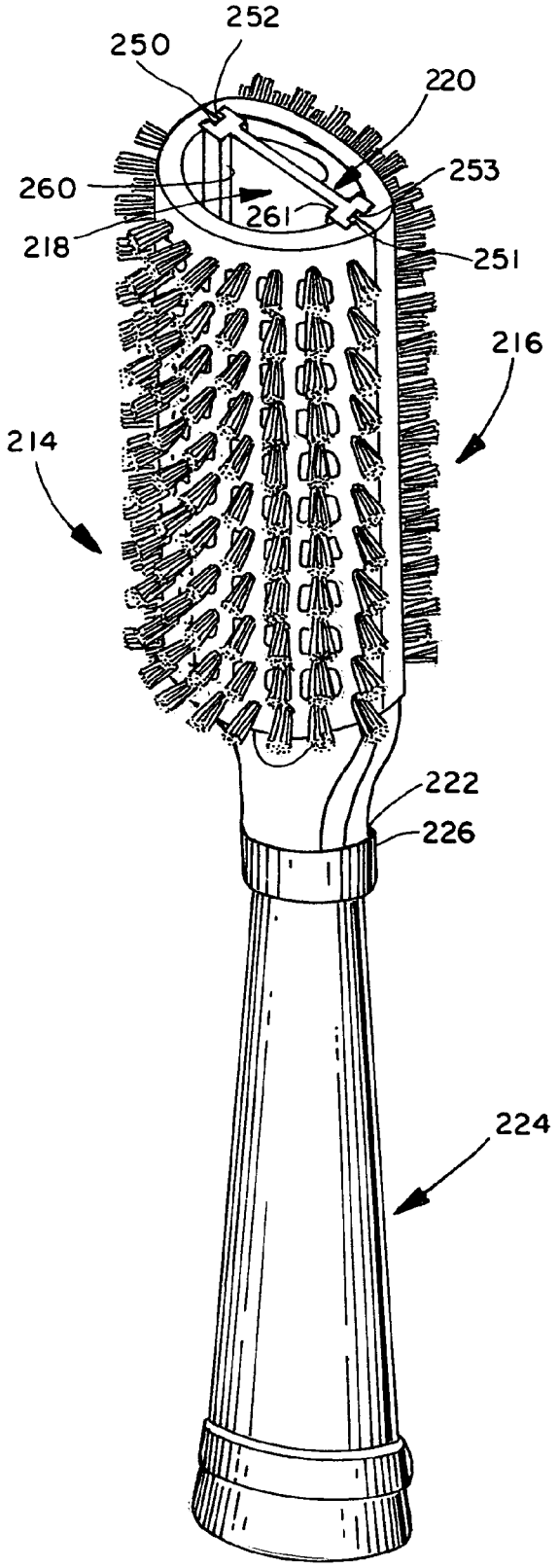
FIG. 2 is an assembled perspective view of the apparatus illustrated in FIG. 1.

Referring now to the drawings, wherein the showings are for purposes of illustrating embodiments of the invention only and not for purposes of limiting the same, FIGS. 1–9 show the components of an apparatus for the management of hair and personal hygiene in accordance with exemplary embodiments of the present invention. FIGS. 1 and 2 show the components of a device for the management of hair in accordance with an exemplary embodiment of the present invention. An apparatus 200 comprises a mounting or central base 212 that removably couples a first hair management implement 214 and a second hair management implement 216 on opposing sides 218,220. In the illustrated embodiment, the mounting base 212 has a cylindrical configuration at a proximal end 222 and the first implement 214 is a half-round bristle brush and the second implement 216 is a half-round bristle brush. A handle 224 can be removably connected to the mounting base 212. The handle 224 includes an interface edge 226. The handle 224 can include a pair of shafts 230, 232 projecting therefrom. The proximal end 222 of the base 212 can include a pair of openings (not illustrated) for receiving the shafts 230, 232, thereby providing a retaining mechanism for removably connecting the handle 224 to the base 212.

Means to facilitate the coupling of the first implement 214 and the second implement 216 into a single apparatus 200 may include first outer mounting edges 240, 241 and second outer mounting edges 242, 243 that are defined at opposing outside edges 244, 246 of the mounting base 212. The first hair management implement can include edges 250, 251 and the second hair management implement can include edges 252, 253 for mounting with the compatible edges 240, 241 and 242, 243. In the illustrated embodiment, the first and second hair management implements 214, 216, when in the mounted position, terminate at shoulders 247, 249 of base 212. Such coupling may be accomplished by any means known in the art, including pin and orifice, snap-fit, interference type fittings, slide friction fittings, and the like. In the illustrated embodiment, the mounting base 212 further includes first inner mounting edges 260, 261 and second inner mounting edges 262, 263 providing alternative mounting means for other implements as described below. As illustrated, each implements can be removably coupled to the mounting base.

Referring now to FIGS. 3–9, it is to be appreciated that other mounting bases and implements can be used with handle 224, to create a family of personal hygiene management implements. For example, the implements can include bath brushes (not shown), stiff toothed hair brushes 316 (FIGS. 3–5), and/or bristle brushes 416 (FIGS. 6–8), etc. The implements can be mixed and matched, such that any pair of implements can be mounted on opposing sides 218, 220 of the base 212.

Figure 5:
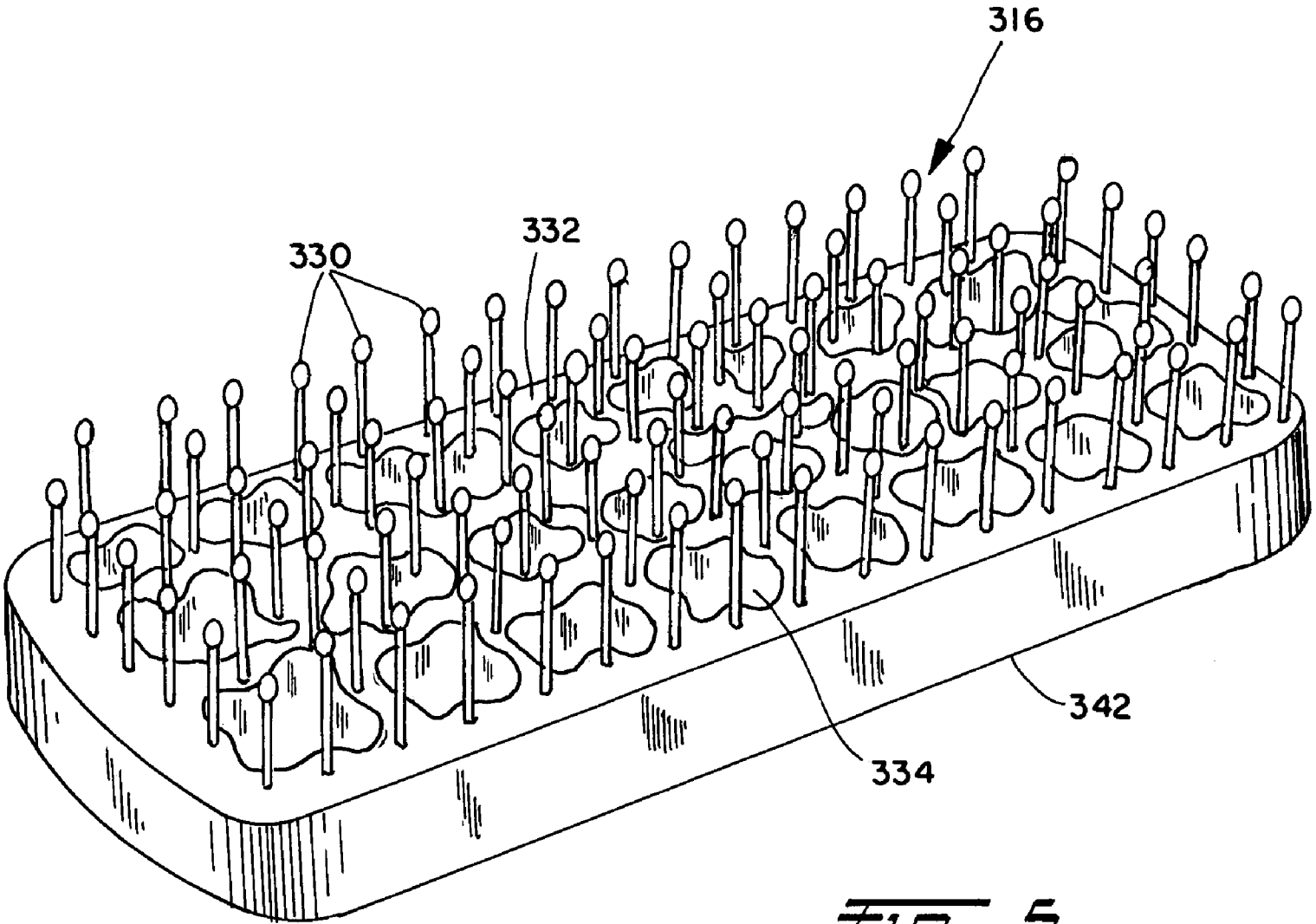
FIG. 5 is a perspective view of the alternative hair management implement shown in FIG. 3.

Referring now to FIGS. 3–5, one example of a hair management implement 316 is therein shown. The implement 316 includes a plurality of stiff teeth 330 projecting from a mounting surface 332. The mounting surface includes a plurality of apertures 334 therethrough to allow items such as dander and small particles to pass between the teeth 330 and through the mounting surface 332 to the base 212, rather than remaining on the mounting surface 332 near the teeth 330 of the implement 316. The apertures 334 can be in the shape of a cruciform and can reduce the surface area of the mounting surface 332 by at least one third. The implement 316 can be removed from the base 212, and the base 212 can be removed from the handle 324 enabling easier cleaning and sanitizing. The implement 316 can alternatively be disposed of, i.e. single use implement, and a new implement can be connected to the base 212 in preparation for another user or another management task creating a more sanitary environment without the need for multiple separate hair management assemblies. Thus, the embodiments, and alternative implements, of FIGS. 1–9 provide for more sanitary implements and the easy and secure connection of two implements.

Referring now to FIG. 4 an interior side 333 is therein shown. The mounting surface 332 can be offset from mounting edges 340, 342 of the implement 316 to allow for a collection space to be created between the side 218 of the base 212 and the interior side 333 of the mounting surface 332.

Figure 7:
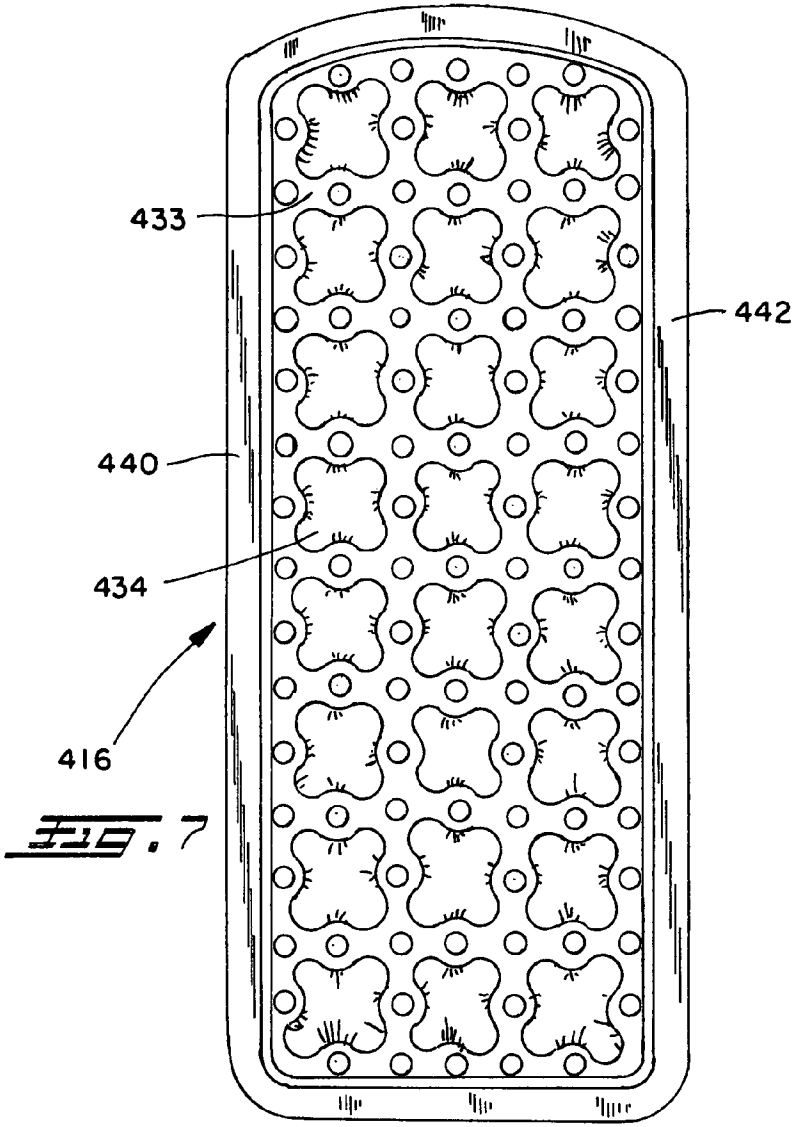
FIG. 7 is a bottom view of the alternative hair management implement shown in FIG. 6.
Figure 8:
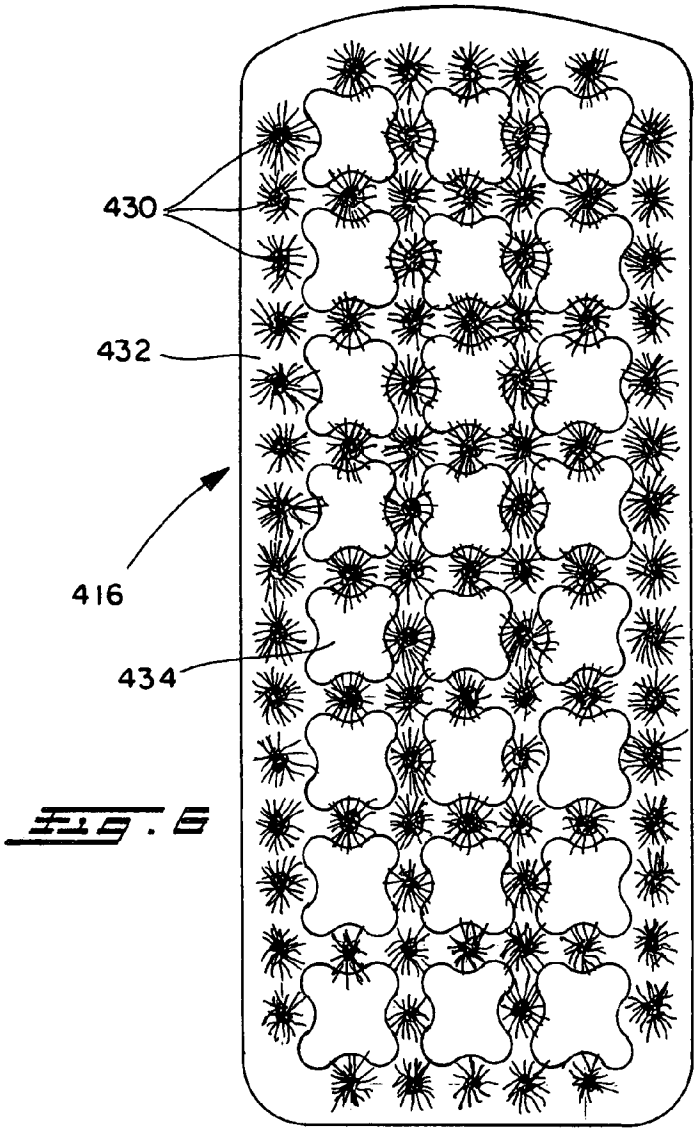
FIG. 8 is a perspective view of the alternative hair management implement shown in FIG. 6; and, FIG. 9 is a perspective view of a personal hygiene management system in accordance with the invention.
Figure 6:
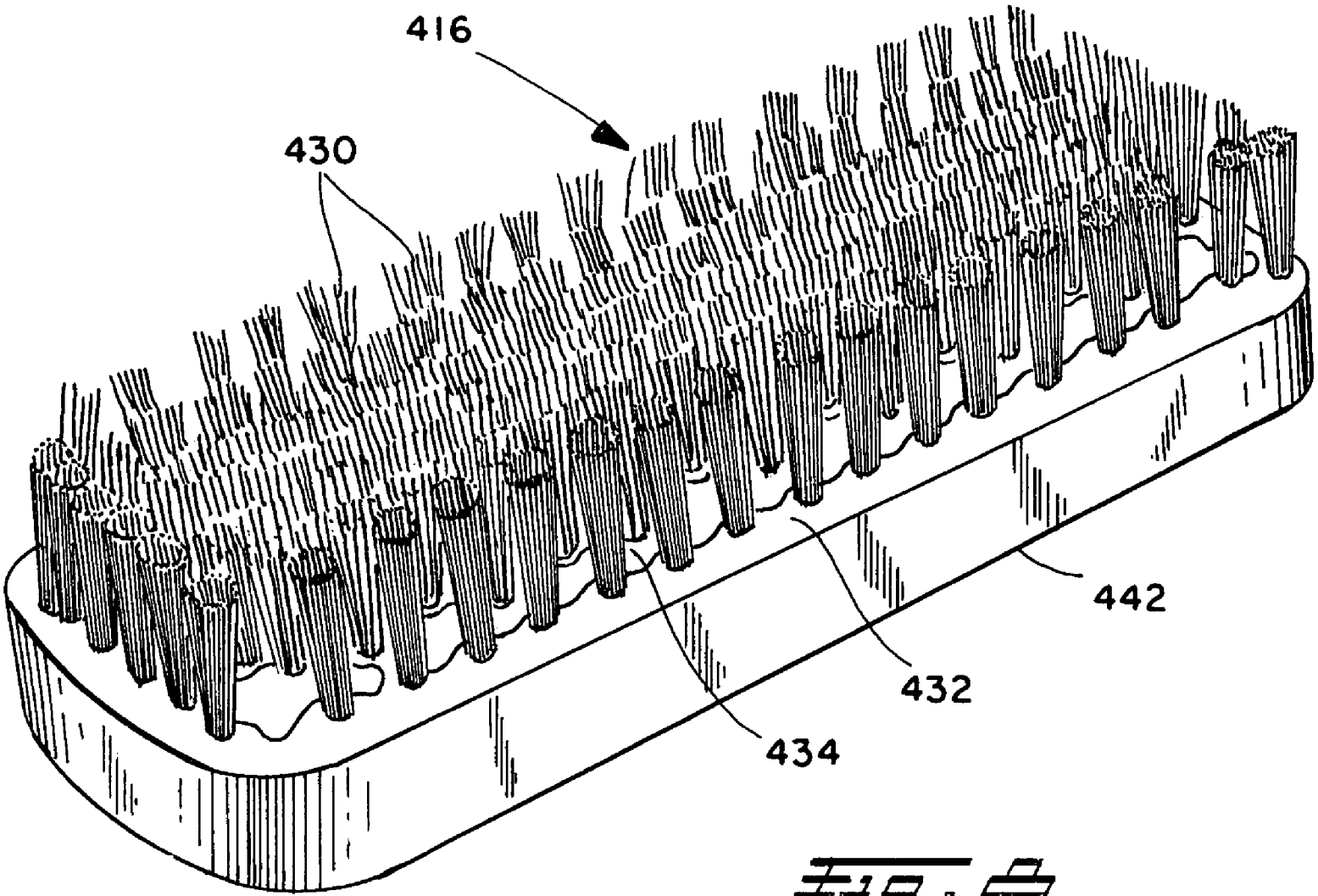
FIG. 6 is a top view of another alternative hair management implement for use with the devices shown in FIG. 1.
Figure 6E:
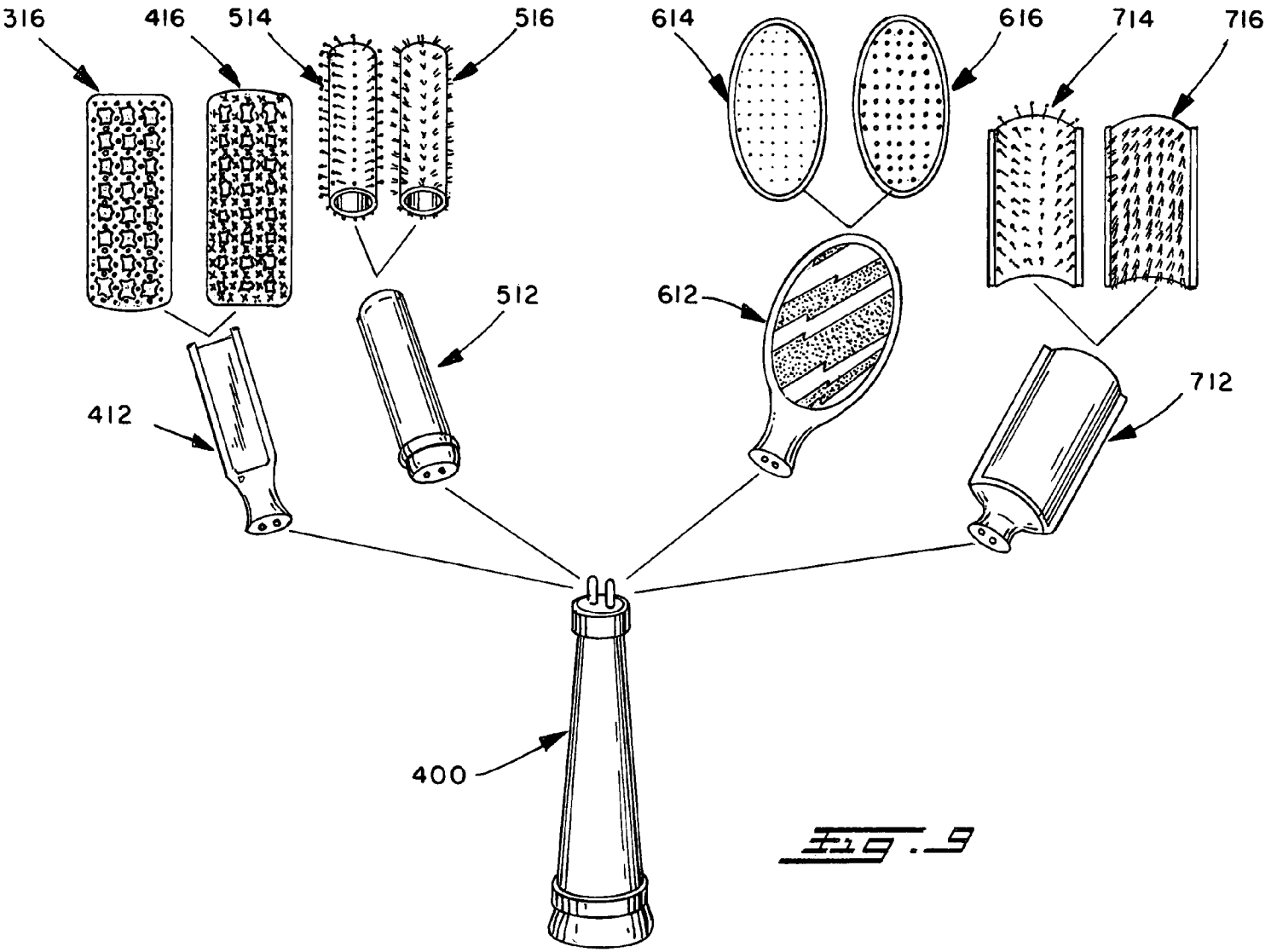

Referring now to FIGS. 6–8, another example of a hair management implement 416 is therein shown. The implement 416 includes a plurality of bristles 430 projecting from a mounting surface 432. The mounting surface 432 includes a plurality of apertures 434 therethrough to allow items such as dander and small particles to pass between the bristles 430 and through the mounting surface 432 to the base 212, rather than remaining on the mounting surface 432 near the bristles 430 of the implement 416. As described above, the apertures 434 can be in the shape of a cruciform and can reduce the surface area of the mounting surface 432 by at least one third. The implement 416 can be removed from the base 212, and the base 212 can be removed from the handle 224 enabling easier cleaning and sanitizing. The implement 416 can alternatively be disposed of, i.e. single use implement, and a new implement can be connected to the base 212 in preparation for another user or another management task creating a more sanitary environment without the need for multiple separate brush assemblies. Similar to FIG. 4, implement 416 includes an interior side 433 of mounting surface 432 offset from mounting edges 440, 442.

As illustrated, the various implements 214, 216, 316, 416 can be selectively removably coupled to the base 212. Thus, the present invention also provides for an apparatus which may be designed to have two different implements for example 316, 416 attached to the mounting base 212 along with the handle 224 or a three-piece (two separate implements both removably coupled to a central mounting base) device. For example, professionals could have multiple implements of the same type and may place many implements in a sterilizing medium while one implement is in use. When a new customer is to be serviced, a clean implement may easily be placed on the mounting base 212.

Referring now to FIG. 9, wherein different bases and different personal hygiene implements are therein shown. The system 400 shown in FIG. 9 includes mounting bases 212, 512, 612 and 712 which are interchangeable with handle 224. Mounting base 212 can be used with one or two implements, for example, implements 316, 416. Mounting base 512 can be used, for example, with implements 514, 516. Mounting base 612 can be used, for example, with implements 614, 616. Mounting base 712 can be used, for example, with implements 714, 716. The system shown in FIG. 9 shows the interchangeability of the different implements in association with different mounting bases. It is to be appreciated that the different implements can be interchanged and configured to suit a single customer. In addition, the separate implements and bases can be separately removed and sterilized in preparation for a second user. It is to be appreciated that implements 316, 416, 514, 516, 614, 616, 714, 716 can be either disposable (one-time use) or multi-use.

Moreover, the entire device could be changed for each customer or use, not only for sanitary reasons, but depending on the implements needed for each customer, as mentioned above. For example, for some individual styles of hair, a comb instrument and a bristle brush instrument may be optimal. Other tools may be selected from the list above or from any other implements typically used for hair care or personal hygiene. Although the examples above describe hair brushes, it is to be appreciated that other personal hygiene implements can be used, i.e. teeth cleaning devices, bath brushes, etc.

Many different hair management instruments may be used in the apparatus o 200, 400 of the present invention. For example, as described above, a stiff toothed hair brush and a bristle brush may be used. Other instruments such as a hair pick may be used. Various tools known in the art may be adapted for use with the mounting base. These tools may include, in addition to those previously described, a single rod tail pick, a clipper attachment, a hair color bottle, a hot comb, a beard comb, a moustache comb and other specialized combs and tools. The specific tool configuration that is used may depend on the particular hair care service that is to be performed, hence making performance of that specific hair care service easier.

Thus, the present invention provides for an apparatus which may be designed to have one or two tools or implements removably coupled to a mounting base, which is in turn removably coupled to a handle. As a result, there is tremendous flexibility for both home users and for professionals. For example, professionals could have multiple instruments of the same type, such as a brush, may place many brushes in a sterilizing medium while one brush is in use. When a new customer is to be serviced, a clean brush may easily be placed on the mounting base. Similarly, for others, a comb and a hair pick may provide the best combination. Other tools may be selected from the list above or from any other instruments typically used for hair care. This interchangeability provides many advantages for professionals and consumers, including greater versatility and sanitation with a tool that can be configured for each customer and/or use.

Home users may also benefit from the advantage of multiple tools given by the present invention. A person could use a single apparatus having two tools, reducing the amount of clutter, and may also be able to exchange multiple tools on the same apparatus. While a comb and a brush may work best at one point, a comb and a fine-toothed moustache comb may be preferred by the user at another point. For a visually impaired person, the use of one multi-instrument apparatus rather than multiple separate items of the prior art is much more convenient. Thus, the present invention allows for multiple advantages to many types of users of hair management devices.

The invention has been described with reference to exemplary embodiments. Obviously, modifications and alterations will occur to others upon reading and understanding the preceding detailed description. It is intended that the invention be construed as including all such modifications and alterations insofar as they come within the scope of the appended claims or the equivalents thereof.

Having thus described the invention, I claim:

1. A system for the management of hair, comprising:

a hair care instrument including a central mounting base including a solid wall having opposing sides, each said side defining a mounting portion in its cross-section, said base including a proximal end;

a first implement removably connected to at least one of said opposing sides of said base;

a handle having an interface edge, said interface edge adjacent said proximal end of said base, wherein said handle is removably connected to said proximal end of said mounting base;

a second implement removably connected to at least another of said opposing sides of said base; and, wherein said first implement and said second implement each include a mounting surface, at least one said mounting surface having a plurality of apertures therethrough wherein an interior side of said at least one said mounting surface defines a collection space for the collection of dirt and dander between said interior side of said at least one said mounting surface and said base.

2. The system for the management of hair of claim 1, wherein said mounting surfaces having a semi-circular cross-section.

3. The system for the management of hair of claim 1, wherein said mounting surfaces having a linear cross-section.

4. The system for the management of hair of claim 1, wherein said second mounting surface having a plurality of apertures therethrough wherein an interior side of said second mounting surface defines a collection space for the collection of dirt and dander between said interior side of said second mounting surface and said base.

5. The system for the management of hair of claim 4, wherein said apertures are generally configured in the shape of a cruciform.

6. The system for the management of hair of claim 4, wherein a surface area defined by said mounting surface is reduced by at least one third by said apertures therethrough.

7. The system for the management of hair of claim 1, wherein said handle includes at least one shaft projecting outward from said interface edge, said base includes at least one opening for receiving said at least one shaft for removably connecting said handle to said base.

8. The system of the management of hair of claim 1, further including a family of hair management implements, said family of hair management implements interchangeable with said first and second implements. said handle to said base.

9. A system for the management of hair, comprising:

a first hair management implement;

a second hair management implement;

a central mounting base including a solid wall having a first side and an opposing second side;

said first hair management implement removably secured to said first side of said central base;

said second hair management implement removably secured to said second side of said central base;

said first and second hair management implements each include a mounting surface and opposing mounting edges, said mounting surfaces include a plurality of apertures therethrough, wherein said mounting edges removably engage said central base; and, wherein said first and said second sides each include recessed portions for the collection of dirt and dander between each said side and an associated said mounting surface.

10. The system for the management of hair of claim 9, wherein said apertures are generally configured in the shape of a cruciform.

11. The system for the management of hair of claim 9, wherein said mounting surface includes a semi-circular cross-section.

12. The system for the management of hair of claim 9 wherein said base includes a proximal end; and, a handle near said proximal end, an interface edge on said handle, at least one shaft connected to said handle at said interface edge, wherein said handle is removably connected to said proximal end of said mounting base.

13. The system for the management of hair of claim 9, wherein at least one of said first and second hair management implements comprises a stiff toothed hair brush.

14. The system for the management of hair of claim 9, wherein at least one of said first and second hair management implements comprises a bristle brush.

15. The system for the management of hair of claim 9, wherein said mounting surface includes bristles secured thereto.

16. The system for the management of hair of claim 9 wherein said at least one of said first and said second hair management implements are selectively removable from said central base and are disposable.

17. The system of the management of hair of claim 9 wherein said at least one of said first and said second hair management implements are selectively removable from said base and said handle for separate cleaning thereof.

18. The system of the management of hair of claim 9, further including a family of hair management implements, said family of hair management implements interchangeable with said first and second hair management implements.

19. A system for the management of personal hygiene, comprising:

a first hair management implement;

a second hair management implement;

a central base including a solid wall having opposing sides each defining a mounting portion;

said first hair management implement removably secured to said first side wall of said central base;

said second hair management implement removably secured to said second side wall of said central base; and, at least one of said first and second hair management implements including a mounting surface and opposing mounting edges, said mounting surface including a plurality of apertures therethrough wherein an interior side of said mounting surface is offset from said mounting edges and defines a collection space between said interior side and said base for the collection of dirt and dander.

20. The system of the management of personal hygiene of claim 19, wherein said second hair management implement including a mounting surface and opposing mounting edges, said second hair management implement mounting surface including a plurality of apertures therethrough wherein an interior side of said mounting surface offset from said mounting edges and defining a collection space between said interior side and said base for the collection of dirt and dander.

21. The system for the management of personal hygiene of claim 19, wherein said at least one of said first and said second hair management implements are selectively removable from said central base and are disposable.

22. The system for the management of personal hygiene of claim 19, further including a family of hair management implements interchangeable with said first and second implements.

23. The system for the management of personal hygiene of claim 19, wherein said at least one of said first and said second hair management implements are selectively removable from said base and said handle for separate cleaning thereof.

24. A system for the management of personal hygiene, comprising:

a first hygiene management implement;

a second hygiene management implement;

a first central base including a solid wall having opposing sides each defining a mounting portion;

said first hygiene management implement removably secured to said first side wall of said first central base;

said second hygiene management implement removably secured to said second side wall of said first central base; and, at least one of said first and second hygiene management implements including a mounting surface and opposing mounting edges, said mounting surface including a plurality of apertures therethrough wherein an interior side of said mounting surface is offset from said mounting edges and defines a collection space between said interior side and said first base for the collection of dirt and dander.

25. The system for the management of personal hygiene of claim 24, further including at least a third hygiene management implement;

at least a second central base interchangeable with said first central base;

said at least third hygiene management implement removably secured to said at least second central base; and, a family of personal hygiene management implements interchangeable with said first, second and third implements.

* * * * *